United States Patent [19]

Harris, Sr.

[11] Patent Number: 4,574,544

[45] Date of Patent: Mar. 11, 1986

[54] INSULATING ROOF SYSTEM FOR MANUFACTURED HOMES AND COMMERCIAL STRUCTURES

[76] Inventor: William P. Harris, Sr., 6361 Nancy Ridge Dr., San Diego, Calif. 92121

[21] Appl. No.: 603,506

[22] Filed: Apr. 24, 1984

[51] Int. Cl.[4] ..... E04B 7/00

[52] U.S. Cl. ..... 52/199; 52/23; 52/96; 52/408

[58] Field of Search ..... 52/199, 198, 11, 12, 52/17, 23, 42, 58, 94, 95, 97, 404, 408, 96

[56] References Cited

U.S. PATENT DOCUMENTS

| | | | |
|---|---|---|---|
| 4,015,376 | 4/1977 | Gerhardt | 52/23 |
| 4,045,922 | 9/1977 | Elliott | 52/94 |
| 4,424,650 | 1/1984 | Van Note | 52/96 |

FOREIGN PATENT DOCUMENTS

| | | | |
|---|---|---|---|
| 2239556 | 6/1981 | Fed. Rep. of Germany | 52/96 |
| 1315334 | 5/1973 | United Kingdom | 52/199 |
| 692956 | 10/1979 | U.S.S.R. | 52/199 |

*Primary Examiner*—Carl D. Friedman
*Assistant Examiner*—Naoko N. Slack

[57] ABSTRACT

An insulating roof system for manufactured homes and similar commercial structures including a base comprised of a single metal roof supported by sidewalls and an interior framing member beneath the base perimeter and having a weatherproofed vapor barrier which supports a layer of flexible insulation and a non-insulating rigid support means which bounds the layer of flexible insulation and houses a plurality of insulation vents which permit the escape of vapor pressure resident within the flexible insulation. A weatherproof membrane is disposed upon the layer of flexible insulation and is supported by the non-insulating rigid support means. A plurality of rigid insulation supports are mounted about roof penetrations and the weatherproof membrane is secured by a mesh strap means disposed over the membrane with a plurality of terminal ends double sealed and secured to the interior framing member by a rust resistant fastening means.

13 Claims, 6 Drawing Figures

INSULATING ROOF SYSTEM FOR MANUFACTURED HOMES AND COMMERCIAL STRUCTURES

DESCRIPTION

TECHNICAL FIELD

The invention relates generally to structural roofing systems and more particularly to a ventilated insulating roof system used for manufactured homes and similar commercial structures.

BACKGROUND ART

In the past, a typical roof structure of an existing mobile home consisted of a layer of galvanized sheet metal set upon a plurality of wood truss members. Ceiling panels of a variety of types were then applied to the underside of the wood truss members creating a cavity between the trusses which generally contained insulation. The type and extent of insulation installed and the quality of construction varied with the home manufacturer and the local and national codes in effect at the time of construction. Advances in roof construction were realized by the contributions disclosed by U.S. Pat. No. 4,045,922 to Elliott and by U.S. Pat. No. 4,424,650 to Van Note. Elliot discloses a roof apparatus for mobile homes and the like which includes several discrete layers of different types of materials, including insulation materials, bonding materials and sealing materials which together provide insulation from heat and cold. Materials are selected for minimizing damage to the mobile home by flexing of the mobile home such as resulting from wind. Van Note discloses an improved roof insulation system and method for a building having a sidewall and an upper supporting surface. The insulation system includes a first substantially rigid insulation disposed about the periphery of the upper surface of the building. A second flexible insulation is disposed within the central area defined by the first rigid insulation thereby insulating the entire upper supporting surface of the building. A flexible waterproof covering is located upon the first and second insulations with the first insulation supporting the periphery of the waterproof covering and with the second insulation supporting the central area of the waterproof covering. Flashing is secured by mechanical fasteners to seal the terminal ends of the waterproof covering to the building about the periphery of the upper supporting surfaces, thereby producing a waterproof insulating roof system.

Notwithstanding the contributions of the prior art, several problems remain in the art of roof construction. The typical roof structure includes an existing metal roof which serves as a waterproofing barrier and a structural component. The insulation material may be applied between the truss members beneath the existing metal roof as previously described or above the existing metal roof and beneath the waterproof covering as disclosed by Elliott and Van Note. One problem is that the insulating material of the prior art is applied in a manner such that the insulation is subject to moisture accumulation and condensation buildup. The varying nature in the installation of insulation material may result in a transition of the temperature at which the moisture condenses into liquid, that is the dew point may shift resulting in condensation buildup in the insulation material. A second problem is that the prior art does not provide a means of escape for the moisture accumulation and condensation buildup in the insulation layer. Since the insulation material retains the condensation, the insulation value degenerates and may not regain the insulative qualities necessary to properly insulate the structure.

One method developed in the prior art to cope with these problems was the utilization of a vapor barrier in the roof structure. It was considered good insulating practice to use the vapor barrier to protect the insulating material from condensation buildup. Generally, the existing metal roof or other metal layer was utilized as the vapor barrier, however the seams of the vapor barrier continued to permit the migration of moisture and condensation and relief of vapor pressure through the vapor barrier. Thus, the moisture accumulation in the insulation material results in a third problem, the accelerated rusting of the original metal roof and subsequent structural inadequacy. The rusting of the metal roof may also cause absorption and retention of heat from solar radiation and the constant exposure to the elements causes significant thermal movement of the metal roof resulting in metal seam deterioration and expansion-contraction noise known as roof rumble. The continued thermal movement of the metal roof particularly at the roof perimeter may result in the eventual rupture of the waterproof covering at the perimeter with the loss of wind uplift resistance and failure of the roof structure. Another problem concerns the need for the reduction of stress on the sealed portions of common roof penetrations. Such stress accommodation is necessary to facilitate the occasional foot traffic on the roof and to extend the life of the roof penetration seals. Another problem concerns the rusting of the mechanical fasteners utilized as connectors in the construction of the structural roof. The rusting leads to the premature failure of the fasteners and also to rust stains on the exterior sidewalls of the mobile home, an esthetic consideration.

Thus, the problems of moisture accumulation and condensation in the insulation resulting in the loss of insulative qualities, the need for a means of escape of the moisture accumulation, the accelerated roof rusting and resultant roof leakage, heat retention and roof rumble, the lack of wind uplift resistance, stress accommodation on roof penetration seals and the rusting and failure of mechanical fasteners continue to exist and have not been solved by the prior art.

It is therefore an object of the present invention to provide an improved insulating roof system capable of retaining the insulative qualities of the insulation layer.

It is a further object to provide an improved insulating roof system capable of releasing vapor pressure through the normal mechanics of gaseous flow.

It is a further object to provide an improved insulating roof system capable of eliminating moisture vapor intrusion.

It is a further object to provide an improved insulating roof system capable of minimizing the stress on roof penetration seals from foot traffic.

It is a further object to provide an improved insulating roof system capable of securely binding the roof to the structure.

DISCLOSURE OF INVENTION

A preferred embodiment of the present invention includes an insulating roof system for manufactured homes and similar structures. The insulating roof system includes a base comprised of multiple sections joined by metal seams forming a single metal roof supported by sidewalls and an interior framing member beneath the perimeter of the base. The base which is a weatherproofed vapor barrier supports a layer of flexible insulation and a non-insulating rigid support means which acts as a boundary for the layer of flexible insulation. A plurality of insulation vents are mounted within the insulating roof system for permitting the escape of vapor pressure and condensation resident within the layer of flexible insulation. A weatherproofing membrane is disposed upon the layer of flexible insulation and is supported by the non-insulating rigid support means and a rust resistant fastening means secures a plurality of terminal ends of the weatherproofing membrane at the interior framing member. The weatherproofed base provides for the elimination of moisture vapor intrusion into the layer of flexible insulation and thus protects the integrity of and maintains the insulative qualities of the layer of flexible insulation. The layer of flexible insulation is vented to provide a release of vapor pressure through the normal mechanics of gaseous flow. Support means are installed in the immediate proximity of fixtures penetrating the weatherproof membrane to minimize the stress on a weatherproof seal about the fixture. The non-insulating rigid support means acts to protect the weatherproof membrane from external objects such as ladders and the fastening means and a mesh strap transversing the insulating roof system act to increase wind uplift resistance.

An advantage of the insulating roof system of the present invention is that the insulative qualities of the insulation layer are retained.

Another advantage is that the insulating roof system is capable of releasing vapor pressure through the mechanics of gaseous flow.

A further advantage is that the insulating roof system is capable of eliminating moisture vapor intrusion.

A further advantage is that the insulating roof system is capable of minimizing the stress on roof penetration seals from foot traffic.

A further advantage is that the insulating roof system is capable of securely binding the roof to the structure.

BEST MODE FOR CARRYING OUT THE INVENTION

Figure 1:
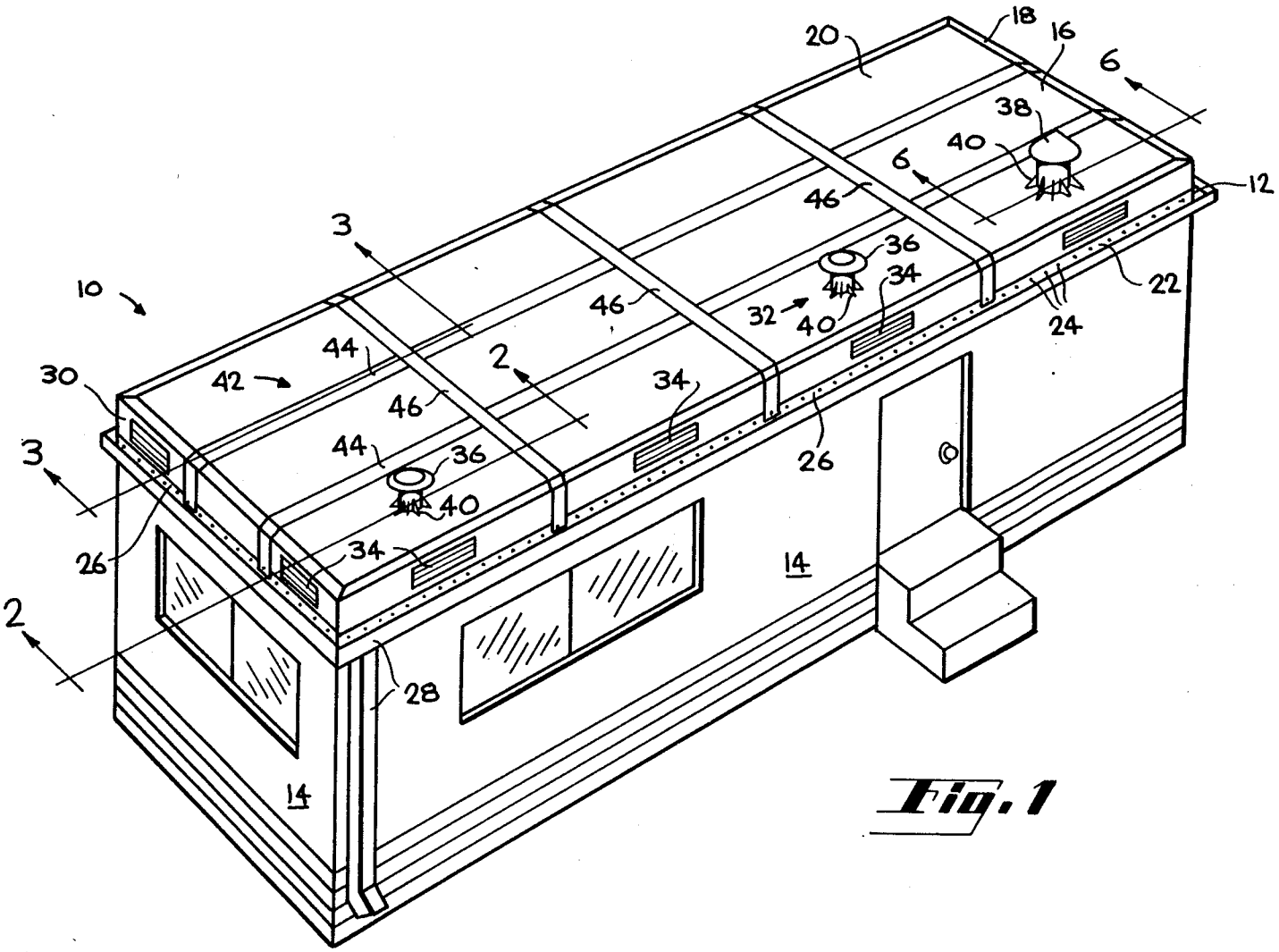
FIG. 1 is a perspective view of an insulating roof system in accord with the present invention.

FIG. 1 illustrates an insulating roof system for a manufactured home or similar commercial structure referred to by the general reference character 10 and incorporating the present invention. The insulating roof system 10 includes a base 12 supported by a plurality of sidewalls 14, an upper horizontal surface 16 with a rounded edge 18, a weatherproof membrane means 20 disposed over the insulating roof system 10 and a fastening means 22 including a plurality of rust resistant screws 24 for securing a plurality of terminal ends 26 of the weatherproof membrane means 20 and a gutter piece 28 to the plurality of sidewalls 14. Mounted within an exterior side 30 of the insulating roof system 10 and the upper horizontal surface 16 is an insulation vent means 32 including a plurality of side louvered vents 34 and a plurality of insulating roof vents 36. Also, one of a plurality of penetrating fixtures 38 passing through the insulating roof system 10 and the base 12 is shown. Each of the insulating roof vents 36 and each of the penetrating fixtures 38 include a weatherproof seal 40 between the weatherproof membrane means 20 and the vent 36 or the fixture 38. Additionally, a mesh strap means 42 is illustrated including a plurality of mesh straps 44 connected to the fastening means 22 and a plurality of weatherproof sleeves 46 used to secure the mesh straps 44 in place.

Figure 2:
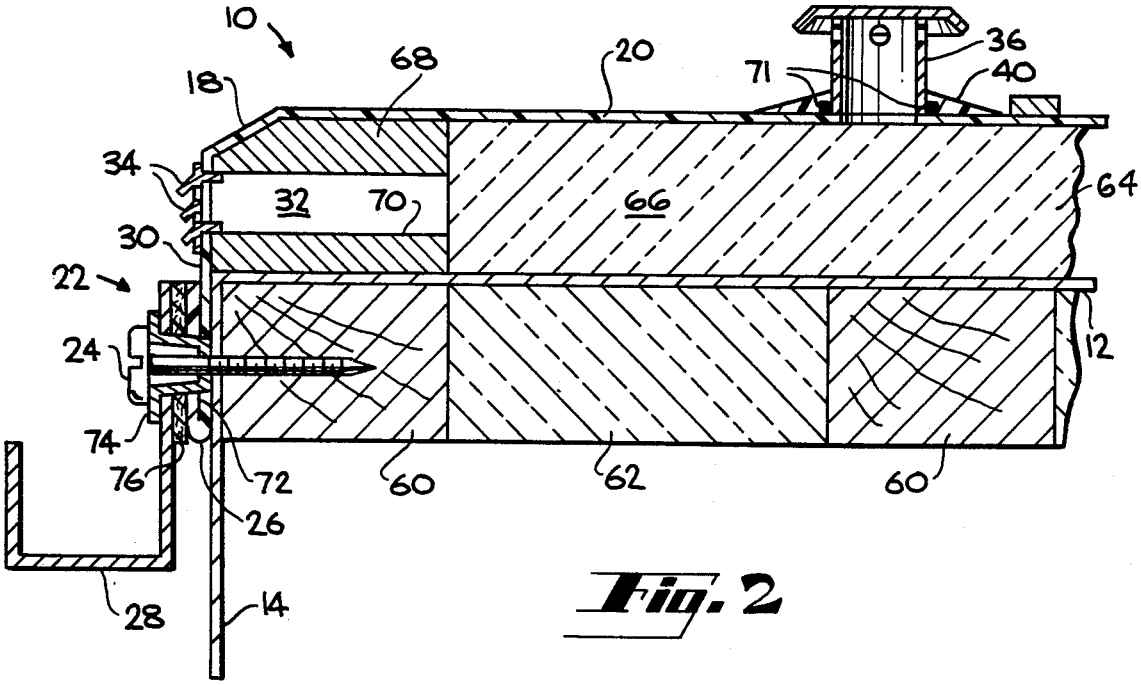
FIG. 2 is a cross sectional view of the insulating roof system taken along the lines 2—2 of FIG. 1.

The base 12 of the insulating roof system 10 is more clearly shown in FIG. 2 which is a cross sectional view taken along lines 2—2 of FIG. 1. The base 12 is comprised of a metal roof supported by sidewall 14 and a first of a plurality of interior framing members 60 beneath the perimeter of the base 12 and adjacent to sidewall 14. The sidewalls 14 are formed of metal but the plurality of interior framing members 60 are usually formed of wood but may include any suitable material such as metal. Beneath the base 12 and bounded by a second of the plurality of interior framing members 60 is an existing insulation section 62 installed by the manufacturer of the home. Additionally, the base 12 supports a layer of flexible insulation 64 within a cavity 66 for insulating the manufactured home from the temperature extremes. The layer of flexible insulation 64 is bounded by a non-insulating rigid support means 68 mounted atop the perimeter of the base 12 and in vertical alignment with said first of said plurality of interior framing members 60. The non-insulating rigid support means 68 also provides structural support to the insulating roof system 10 by supporting the weight of and the tension on the weatherproof membrane means 20. Recognizing that homeowners may frequent the roofs of their homes, the non-insulating rigid support means 68 located at the perimeter of the insulating roof system 10 protects the weatherproof membrane means 20 from the wear attendant with placing a ladder on a flexible or semi-rigid insulation layer. Because of the shape of the non-insulating rigid support means 68, the otherwise sharp bend that the weatherproof membrane means 20 would make is eliminated and replaced with the rounded edge 18. This feature helps to avoid early failure of the weatherproof membrane means 20 with resultant roof leakage because the rounded edge 18 provides a rounded support surface to the weatherproof membrane means 20 between the upper horizontal surface 16 and the plurality of sidewalls 14.

The insulation vent means 32 contained within the insulating roof system 10 permits the layer of flexible insulation 64 to be vented through one of two methods designed to provide a release of vapor pressure through the normal mechanics of gaseous flow. It is necessary to provide for the escape of vapor pressure and condensation resident within the layer of flexible insulation 64 to retain the insulative qualities. Entrapment of moisture within the layer of flexible insulation 64 will result in increasingly deficient insulation values. To this end, the insulation vent means 32 includes the plurality of side louvered vents 34 and may include the plurality of insulating roof vents 36. The side louvered vents 34 are mounted on the exterior side 30 or perimeter of the insulating roof system 10 on eight-foot center intervals. The exterior side 30 of the insulating roof system 10 is adjacent to the external face of the non-insulating rigid support means 68. Each of the plurality of side louvered vents 34 includes a vent shaft 70 housed within the non-insulating rigid support means 68 which abuts the layer of flexible insulation 64 within cavity 66. The plurality of insulating roof vents 36 are of the solar variety and are mounted atop the manufactured home which has a roof span in excess of fourteen feet between side louvered vents 34. Each of the plurality of insulating roof vents 36 is mounted within a rigid foam support 71 approximately three inches thick and two feet on a side. The rigid foam support 71 is mounted upon the layer of flexible insulation 64 and may be comprised of isocyanurate or polyurethane rigid foam. The plurality of insulating roof vents 36 includes the weatherproof seal 40 between the weatherproof membrane means 20 and each of the insulating roof vents 36 which completely seals the rigid foam support 71. Each of the side louvered vents 34 and insulating roof vents 36 may be made of lightweight materials and are arranged in relation to cavity 66 to promote air circulation within the layer of flexible insulation 64. The weatherproof membrane means 20 is disposed upon the layer of flexible insulation 64 and the non-insulating rigid support means 68 for sealing the insulating roof system 10 and may comprise a flexible, semi-flexible or rigid waterproofing membrane. There is not a preferable waterproofing material but a suitable membrane material is a 40-mil, single-ply material manufactured by the B. F. Goodrich Co. and marketed under the name "Lexply." The weatherproof membrane means 20 includes the plurality of terminal ends 26 which are folded in such a manner as to assure a double seal 72 which substantially increases the resistance of the weatherproof membrane means 20 to tearing where the fastening means 22 penetrates. This improves wind uplift protection.

Figure 3:
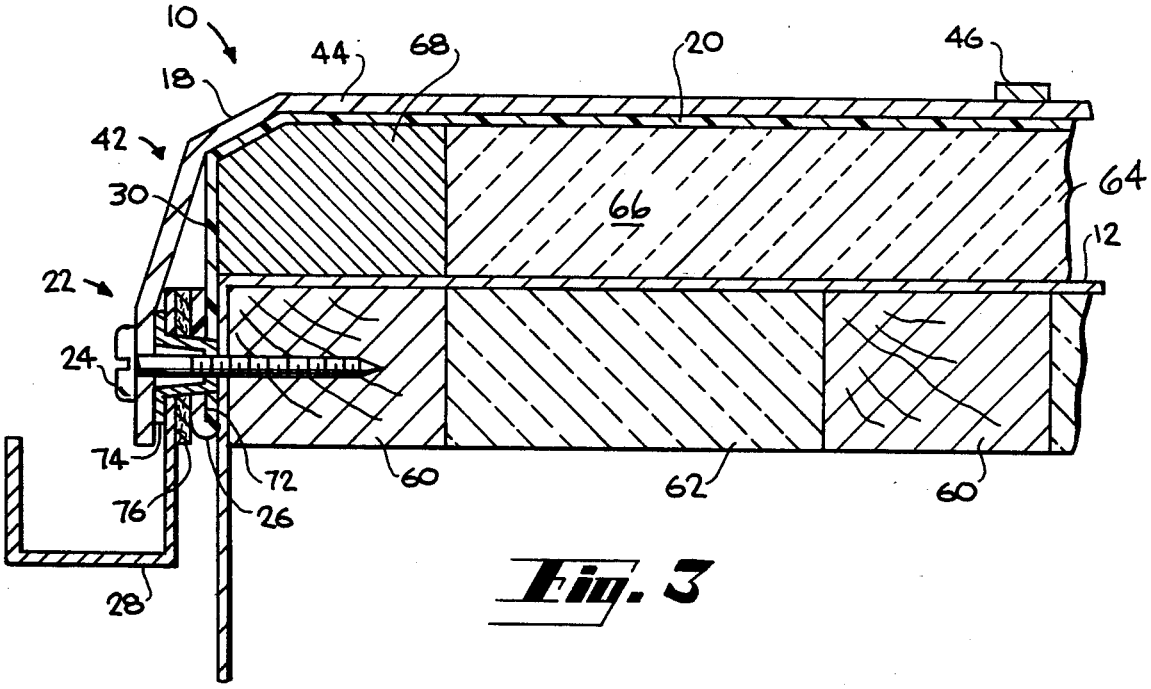
FIG. 3 is a cross sectional view of the insulating roof system taken along lines 3—3 of FIG. 1.

The fastening means 22 is illustrated in FIGS. 2 and 3 and is used to secure the plurality of terminal ends 26 of both the weatherproof membrane means 20 and the mesh strap means 46, shown in FIG. 3. The fastening means 22 is secured to the first of said plurality of interior framing members 60 located beneath the perimeter of the base 12. The fastening means 22 may include a plurality of cup-shaped metal collars 74 or eyelets for penetrating the double seal fold 72 and are used to protect and to isolate the weatherproof membrane means 20 from the fastening means 22. Additionally, the fastening means 22 comprises the plurality of rust resistant screws 24 which may be wood screws or metal screws depending upon the material used for the first of the plurality of interior framing members 60. Each rust resistant screw 24 may be inserted through one of the cup-shaped metal collars 74 which eliminates premature rust failure of the fastening means 22 and rust stains on the sidewalls 14. However, each rust resistant screw 24 may penetrate the double seal fold 72 without the use of the cup-shaped metal collar 74 and without tearing the weatherproof membrane means 20. The cup-shaped metal collar 74, if one is used, and the rust resistant screw 24 also penetrate the gutter piece 28 which redirects the water runoff from the insulating roof system 10. The gutter piece 28 is separated and insulated from the weatherproof membrane means 20 by a layer of tape caulk 76. At each location in which one of the plurality of side louvered vents 34 and vent shafts 70 pass through the weatherproof membrane means 20 and the non-insulating rigid support means 68, the weatherproof membrane means 20 is secured to the exterior side 30 by liquid rubber.

The mesh strap means 42 of the insulating roof system 10 is more clearly illustrated in FIG. 3 which is a cross-sectional view taken along lines 3—3 of FIG. 1. The mesh strap means 42 includes the plurality of mesh straps 44 which are preferably comprised of nylon but may be made of any weatherproof material with sufficient strength characteristics. The mesh straps 44 are transversely disposed upon the weatherproof membrane means 20 so as to avoid each insulating roof vent 36 and each penetrating fixture 38 and the plurality of terminal ends 26 of the plurality of mesh straps 44 are secured to the first of the interior framing members 60 by the fastening means 22. The plurality of mesh straps 44 are retained in position on the insulating roof system 10 by a plurality of sleeves 46 comprised of the weatherproof membrane material and secured by the fastening means 22 as shown in FIG. 1. However, both the plurality of mesh straps 44 and the plurality of sleeves 46 may be secured to the insulating roof system 10 by any acceptable means. The mesh strap means 42 is employed to increase the wind uplift resistance of the insulating roof system 10 and to eliminate the movement of the base 12 particularly at the exterior side 30 which significantly reduces the failure of the weatherproof membrane means 20 and wind uplift damage. The remainder of FIG. 3 duplicates FIG. 2 except for the omission of the insulation vent means 32.

Figure 4:
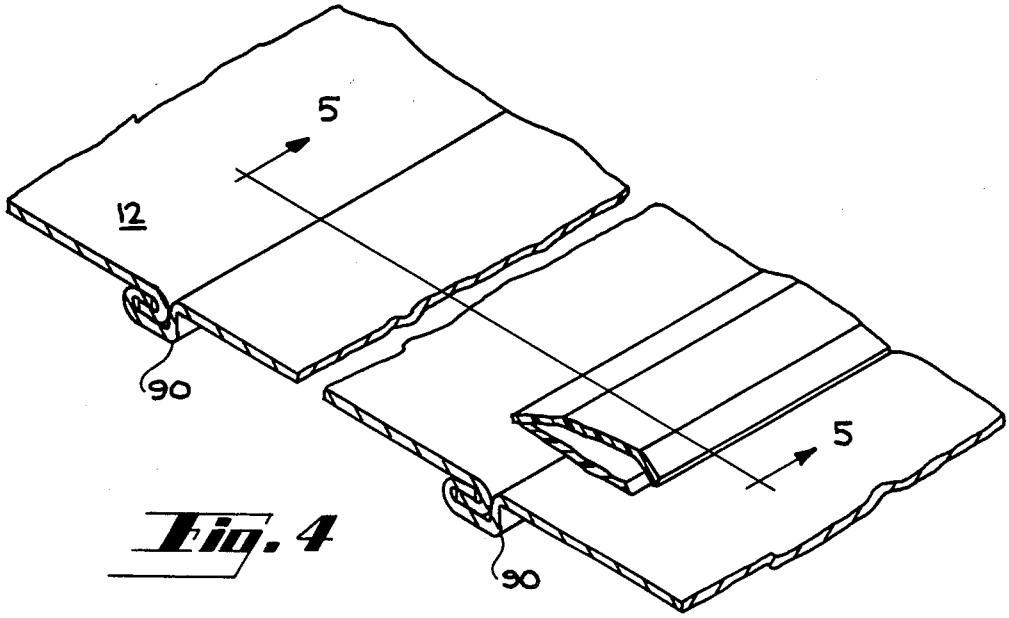
FIG. 4 is a partial perspective view of a base metal roof of the insulating roof system of FIG. 1.
Figure 5:
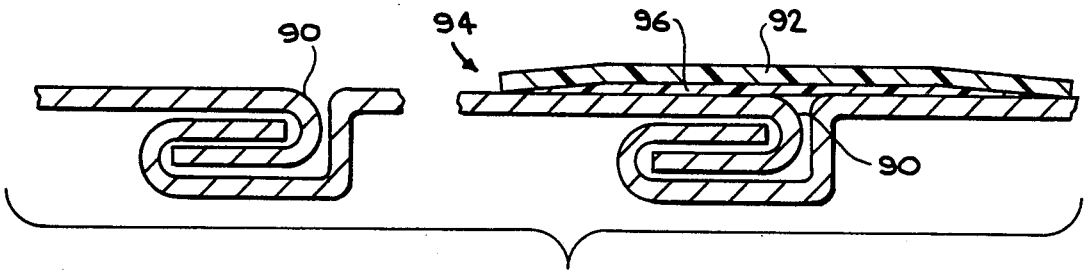
FIG. 5 is a cross sectional view of the base metal roof of FIG. 4.

The base is shown in partial perspective in FIG. 4 and in cross section in FIG. 5. The major source of moisture vapor penetration into the existing insulation section 62 and the layer of flexible insulation 64 is through the existing metal roof or base 12 at penetrations and seams in the roof. The base 12 includes a plurality of metal roof seams 90 which join sections of the metal roof to form the complete base 12. FIG. 5 illustrates the mechanical nature of the plurality of metal roof seams 90. Each of the plurality of metal roof seams 90 is sealed and weatherproofed by one of a plurality of self-adhesive weatherproofing material strips 92 for providing a weatherproofed vapor barrier 94 for eliminating moisture vapor instrusion and for protecting the integrity of the insulating roof system 10. Thus by weatherproofing the plurality of metal roof seams 90, migration of moisture vapor and relief of vapor pressure through the base 12 is prevented. Note that by weatherproofing the base 12, moisture and warm air are also prevented from passing upward through the metal roof seams 90 into the layer of flexible insulation 64 from within the manufactured home. The weatherproofed vapor barrier 94 acting in conjunction with the insulation vent means 32 prevent the accelerated rusting of the base 12 which prevents roof leakage and reduces the absorption and retention of heat in the roof from solar radiation. FIG. 5 illustrates one of the plurality of self-adhesive weatherproofing material strips 92 applied to one of the metal roof seams 90. A bonding adhesive 96 resident in each of the self-adhesive weatherproofing material strips 92 is employed to seal each of the self-adhesive weatherproofing material strips 92 to each of the metal roof seams 90.

Figure 6:
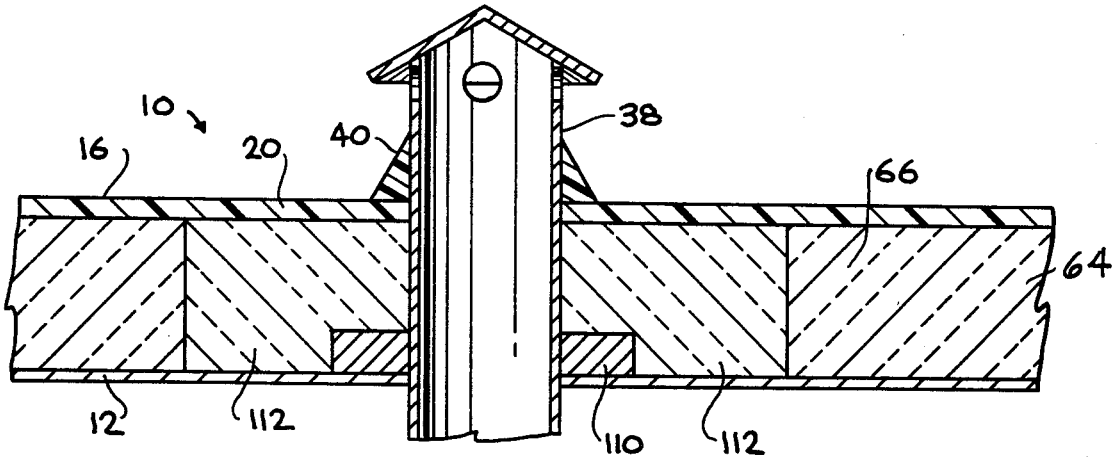
FIG. 6 is a cross sectional view of the insulating roof system taken along lines 6—6 of FIG. 1.

Penetrations through the insulating roof system 10 and the base 12 are more clearly illustrated in FIG. 6 which is a cross section taken along lines 6—6 of FIG. 1. One of the penetrating fixtures 38 is shown extending above the insulating roof system 10 and the base 12 with the weatherproof seal 40 being disposed between the upper horizontal surface 16 and the penetrating fixture 38. The weatherproof seal 40 includes flashing material which is well known in the art. A compound of long-life expectancy caulk 110 is disposed about the base 12 at the interface with the penetrating fixture 38 to complete the weatherproof seal 40. By sealing all penetrations in the insulating roof system 10 and by weatherproofing the metal roof seams 90, the existing metal roof is reestablished as a waterproof component and effective vapor barrier 94. In order to distribute the stress from foot traffic on the weatherproof seal 40, a plurality of rigid insulation supports 112 are mounted upon the base 12 adjacent to the layer of flexible insulation 64 and beneath the weatherproof membrane means 20. Each of the plurality of rigid insulation supports 112 surrounds one of the penetrating fixtures 38 passing through the base 12 and the insulating roof system 10. Note that the rigid insulation supports 112 prevent damage to the weatherproof seal 40 that would otherwise occur if only the layer of flexible insulation 64 was available to support foot traffic required by occasional roof inspection and repair. Each of the rigid insulation supports 112 reduces the shearing stress on the weatherproof seal 40 thus reducing the probability of roof leakage and insulation degeneration.

The insulating roof system 10 is designed to be successfully adapted to existing manufactured homes and similar commercial structures, however the insulating roof system 10 is equally adaptable in the manufacturing stage of the original home or structure.

I claim:

1. An insulating roof system for manufactured homes and commercial structures comprising, a base for supporting an insulating roof system, said base being supported by a plurality of sidewalls and having an interior framing member beneath the perimeter of said base, said base being a weatherproofed vapor barrier for protecting the integrity of the insulating roof system, a layer of flexible insulation in mechanical communication with said base for providing insulation from the temperature extremes of the elements, said layer of flexible insulation extending partway to said perimeter of said base, a non-insulating rigid support means mounted atop and in contact with the perimeter of said base for providing structural support to the insulating roof system and for serving as a boundary for containing said layer of flexible insulation, an insulation vent means contained within the insulating roof system for the escape of vapor pressure and condensation resident within said layer of flexible insulation, said insulation vent means comprising a plurality of side vents, each side vent having a vent shaft housed within said non-insulating rigid support means, a weatherproof membrane means disposed upon said layer of flexible insulation and said non-insulating rigid support means for sealing the insulating roof system, and a fastening means for securing a plurality of terminal ends of said weatherproof membrane means at said interior framing member beneath said perimeter of said base.

2. The insulating roof system of claim 1 wherein said weatherproof membrane means comprises a flexible waterproofing membrane.

3. The insulating roof system of claim 1 wherein said weatherproof membrane means comprises a semiflexible waterproofing membrane.

4. The insulating roof system of claim 1 wherein said weatherproof membrane means comprises a rigid waterproofing membrane.

5. The insulating roof system of claim 1 wherein said structural support to the insulating roof system by said non-insulating rigid support means provides a rounded support surface to said weatherproof membrane means between an upper horizontal surface of the insulating roof system and said plurality of sidewalls for minimizing damage to the weatherproof membrane means.

6. An insulating roof system for manufactured homes and commercial structures comprising, a base comprised of a metal roof for supporting an insulating roof system, said base being supported by a plurality of sidewalls and having an interior framing member beneath the perimeter of said base and adjacent to each of said sidewalls, said base being a weatherproofed vapor barrier for protecting the integrity of the insulating roof system, a layer of flexible insulation in mechanical communication with said base for providing insulation from the temperature extremes of the elements, said layer of flexible insulation extending partway to said perimeter of said base, a non-insulating rigid support means mounted atop and in contact with the perimeter of said base for providing structural support to the insulating roof system and for serving as a boundary for containing said layer of flexible insulation, an insulation vent means contained within the insulating roof system including a plurality of louvered side vents housed within said non-insulating rigid support means and a plurality of insulating roof vents mounted atop the insulating roof system for the escape of vapor pressure and condensation resident within said layer of flexible insulation, a weatherproof membrane means disposed upon said layer of flexible insulation and said non-insulating rigid support means for sealing the insulating roof system, and a fastening means for securing a plurality of terminal ends of said weatherproof membrane means at said interior framing member beneath said perimeter of said base, said fastening means including a plurality of metal collars for penetrating a double seal fold of said weatherproof membrane means for isolating said weatherproof membrane means from said fastening means.

7. The insulating roof system of claim 6 wherein said fastening means comprises a plurality of rust resistant screws, each of said plurality of rust resistant screws being affixed to said interior framing member through one of said plurality of metal collars.

8. The insulating roof system of claim 6 wherein said base further includes a plurality of metal roof seams, each of said plurality of metal roof seams being sealed by one of a plurality of self-adhesive weatherproofing material strips for providing said weatherproofed vapor barrier.

9. The insulating roof system of claim 6 further comprising, a mesh strap means for securing the insulating roof system and being transversely disposed upon said weatherproof membrane means and being retained by a sleeve for providing resistance to an uplifting wind, said mesh strap means having a plurality of terminal ends secured by said fastening means.

10. The insulating roof system of claim 9 wherein said mesh strap means includes a mesh strap comprised of nylon and said sleeve being comprised of a waterproofing membrane.

11. An insulating roof system for manufactured homes and commercial structures comprising, a base comprised of a metal roof for supporting an insulating roof system, said base being supported by a plurality of sidewalls and having an interior framing member beneath the perimeter of said base and adjacent to each of said sidewalls, said base including a plurality of metal roof seams, each seam being sealed by one of a plurality of self-adhesive weatherproofing material strips for providing a weatherproofed vapor barrier for protecting the integrity of the insulating roof system, a layer of flexible insulation in mechanical communication with said base for providing insulation from the temperature extremes of the elements, said layer of flexible insulation extending partway to said perimeter of said base, a non-insulating rigid support means mounted atop and in contact with the perimeter of said base for providing structural support to the insulating roof system and for serving as a boundary for containing said layer of flexible insulation, an insulation vent means contained within the insulating roof system for the escape of vapor pressure and condensation resident within said layer of flexible insulation, said insulation vent means including a plurality of louvered side vents, each of said plurality of louvered side vents having a vent shaft housed within said non-insulating rigid support means with each of said plurality of louvered vents mounted on an external face of said non-insulating rigid support means and the insulation vent means further including a plurality of insulating roof vents mounted atop the insulating roof system and accessible from a cavity housing said layer of flexible insulation, a weatherproof membrane means disposed upon said layer of flexible insulation and said non-insulating rigid support means for sealing the insulating roof system, a plurality of rigid insulation supports mounted upon said base adjacent to said layer of flexible insulation and beneath said weatherproof membrane means, each of said plurality of rigid insulation supports surrounding one of a plurality of fixtures penetrating said base and the insulating roof system, said plurality of rigid insulation supports for reducing the mechanical stress on a seal between said weatherproof membrane means and each of said plurality of fixtures, a mesh strap means for securing the insulating roof system and being transversely disposed upon said weatherproof membrane means and being retained by a sleeve for providing resistance to an uplifting wind, and a fastening means for securing a plurality of terminal ends of said weatherproof membrane means and of said mesh strap means at said interior framing member beneath said perimeter of said base, said fastening means including a plurality of rust resistant screws and a plurality of cup-shaped metal collars for penetrating a double seal fold of said weatherproof membrane means for protecting and for isolating said weatherproof membrane means from said fastening means.

12. The insulating roof system of claim 11 wherein said seal between said weatherproof membrane means and each of said plurality of fixtures comprises long-life expectancy caulk and weatherproof flashing.

13. The insulating roof system of claim 12 further including a gutter piece for directing water runoff from the insulating roof system, said gutter piece being affixed to said plurality of sidewalls by said plurality of rust resistant screws, each rust resistant screw passing through one of said plurality of cup-shaped metal collars, said gutter piece being separated from said weatherproof membrane means by a layer of tape caulk.

* * * * *